US006106437A

United States Patent [19]

Brooks

[11] Patent Number: 6,106,437

[45] Date of Patent: Aug. 22, 2000

[54] NECK THERAPY EXERCISE APPARATUS

[76] Inventor: David A. Brooks, 18440 Hatteras St., Apt. 209, Tarzana, Calif. 91356

[21] Appl. No.: 09/164,083

[22] Filed: Sep. 30, 1998

[51] Int. Cl.[7] ..... A63B 23/025

[52] U.S. Cl. ..... 482/10; 482/103; 601/39; 602/18

[58] Field of Search ..... 482/10, 93, 99, 482/101, 102, 103, 105, 124, 904, 908; 601/39; 602/32–36, 17, 18

[56] References Cited

U.S. PATENT DOCUMENTS

| | | | |
|---|---|---|---|
| 559,270 | 4/1896 | Edwards | 482/10 |
| 1,517,147 | 11/1924 | Burnett | 482/10 |
| 1,543,346 | 6/1925 | Titus | 482/10 |
| 3,826,490 | 7/1974 | Mossman | 482/94 |
| 4,537,393 | 8/1985 | Kusch | 482/10 |
| 4,645,198 | 2/1987 | Levenston | 482/10 |
| 5,738,613 | 4/1998 | Clayton | 482/102 |
| 5,928,117 | 7/1999 | Vittone et al. | 482/10 |
| 5,984,836 | 11/1999 | Casali | 482/10 |

FOREIGN PATENT DOCUMENTS

| | | | |
|---|---|---|---|
| 1509073 | 9/1989 | U.S.S.R. | 482/10 |

*Primary Examiner*—John Mulcahy
*Assistant Examiner*—Victor K. Hwang
*Attorney, Agent, or Firm*—Allan M. Shapiro

[57] ABSTRACT

The neck therapy exercise apparatus comprises a resistance frame in the form of a circular ring at head level of the user. The resistance frame carries pulleys thereon. The user wears a helmet with attachment eyes thereon. Weights are attached to cords which pass through the pulleys and are hooked to selected eyes on the helmet so that cervical spine muscle exercises are done against resistance which is in the plane of the head to prevent downward loading on the spine. More than one weight and cord can be used at the same time to provide torque resistance about a vertical axis. Hand grips are provided to maintain position of the torso.

18 Claims, 4 Drawing Sheets

NECK THERAPY EXERCISE APPARATUS

FIELD OF THE INVENTION

This invention is directed to an apparatus which permits resistance exercises to the muscles adjacent the cervical spine. The exercise apparatus is configured to permit a therapist to define specific resistance exercises to the cervical musculature.

BACKGROUND OF THE INVENTION

Some neck and upper back problems are the result of inadequate musculature to properly support the cervical spine. Exercise is necessary to strengthen the proper muscles. The musculature in that area is very complex so that it is necessary for a highly trained person, educated in that field of activity, to recognize the muscles which require exercise and to define the necessary exercise. Proper exercise is always against a resistance but particularly in the case of the cervical spine, the resistance must be in the appropriate direction and proportion for the desired result. The compressive forces must be minimized in order to prevent irritation of the interfacing joint surfaces, which would increase compression on the spine. Furthermore, the resistance force must not be directly posterior.

Thus there is a need for an exercise apparatus which permits various specific resistance exercises, with different resistances and directions of resistance, without the resistance applying excessive downward neck load, to optimize cervical muscular therapy.

SUMMARY OF THE INVENTION

In order to aid in the understanding of this invention, it can be stated in essentially summary form that it is directed to a neck therapy exercise apparatus which includes a helmet securely mounted on the head of the person who requires cervical musculature exercise, together with a resistance frame. The resistance frame extends at least a portion of the way around the user and attachment points are positioned around the resistance frame. Force devices are connected between the helmet and the attachment points so that the user meets resistance in a generally horizontal direction as he moves his head in the prescribed exercise patterns. The exercise apparatus may include hand grips to properly position the person with respect to the frame in order to correspond to the cervical movement pattern being performed.

It is thus a purpose and advantage of this invention to provide a neck therapy exercise apparatus which applies horizontal forces between a helmet worn by the exerciser and a resistance frame so that vertical forces are avoided as the person moves his head in an exercise regimen.

It is another purpose and advantage of the invention to provide a resistance frame with a plurality of attachment points positioned around the user's position and a helmet for wearing by the user so that force attachment can be connected between the helmet and the resistance frame, generally in a horizontal direction.

It is a further purpose and advantage of the invention to provide a neck therapy exercise apparatus wherein the resistance is provided in the form of weights connected through flexible tension members to the helmet worn by the person exercising, with the resistance frame guiding tension members to provide substantially only horizontal forces to the helmet worn by the user.

It is a further purpose and advantage of the invention to allow the person using it to strengthen the muscles supporting his cervical spine in the most natural pattern in order to restore normal function and power production.

It is a further purpose and advantage of the invention to provide hand grips to determine the placement of the user's arms in a position compatible with extension or flexion patterned movements depending on what cervical movement pattern is being performed.

The features of the present invention which are believed to be novel are set forth with particularity in the appended claims. The present invention, both as to its organization and manner of operation, together with further purposes and advantages thereof, may be best understood by reference to the following description, taken in conjunction with the accompanying drawings.

DESCRIPTION OF THE PREFERRED EMBODIMENT

Figure 1:
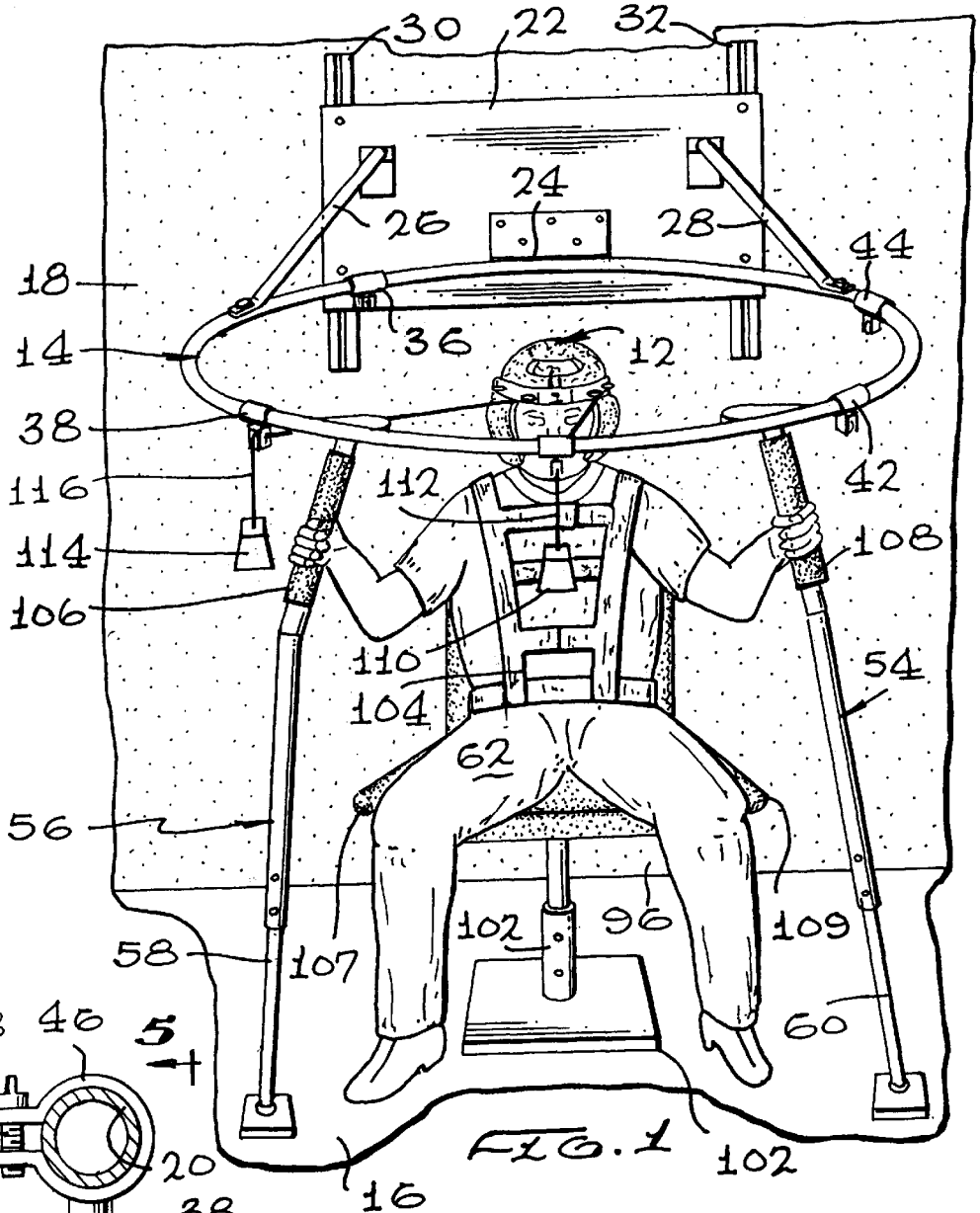
FIG. 1 is a front perspective view of the neck therapy exercise apparatus of this invention as seen with a user therein.
Figure 2:
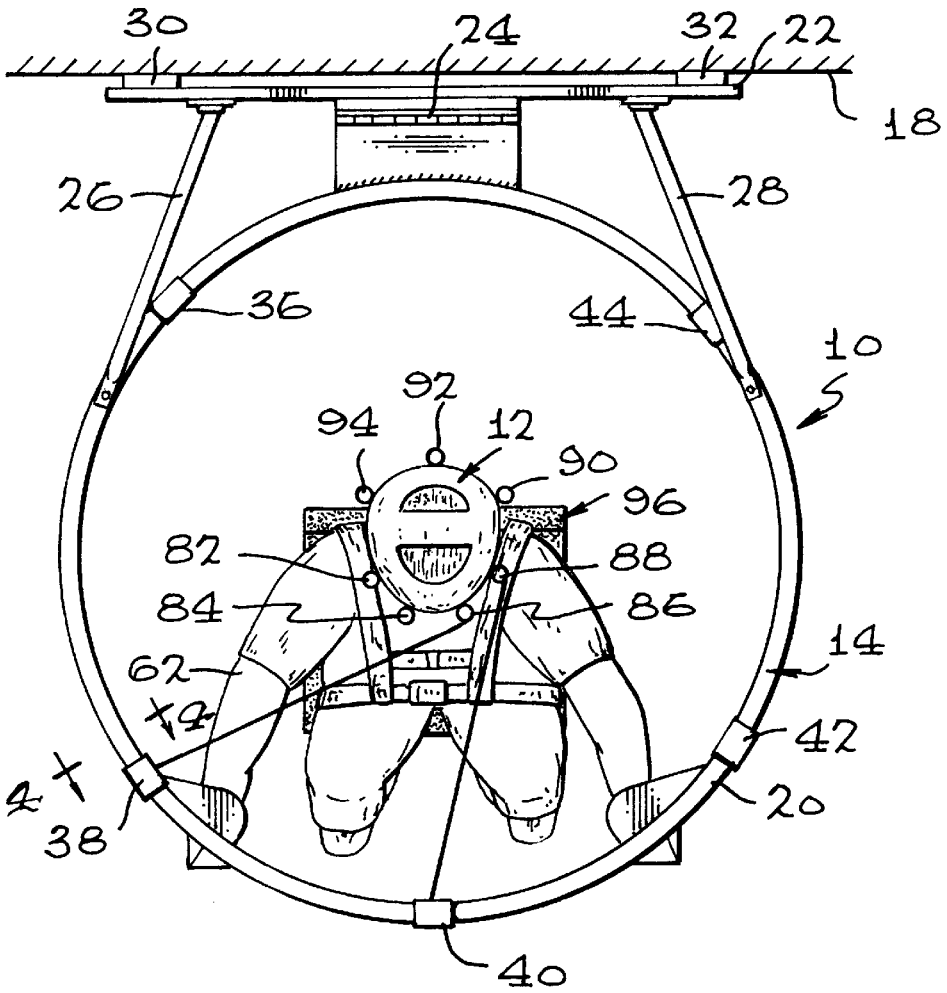
FIG. 2 is a plan view thereof.
Figure 6:
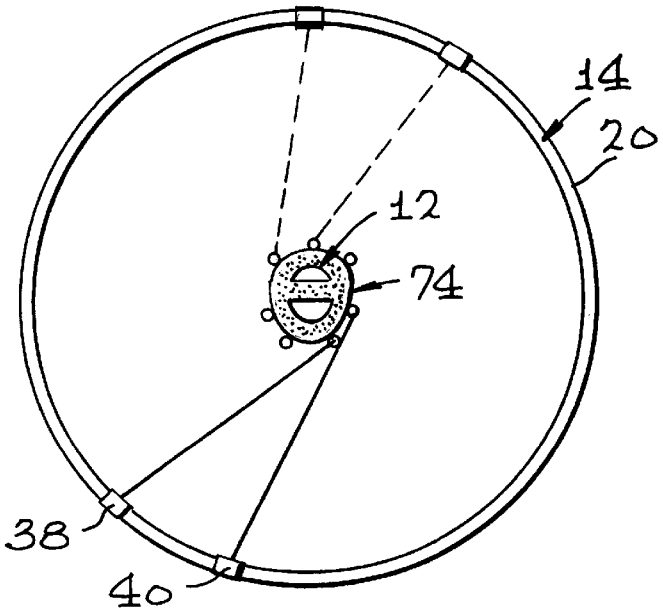
FIG. 6 is a simplified and reduced diagrammatic view of the structure of FIG. 2, shown with a different exercise hookup.
Figures 3, 9:
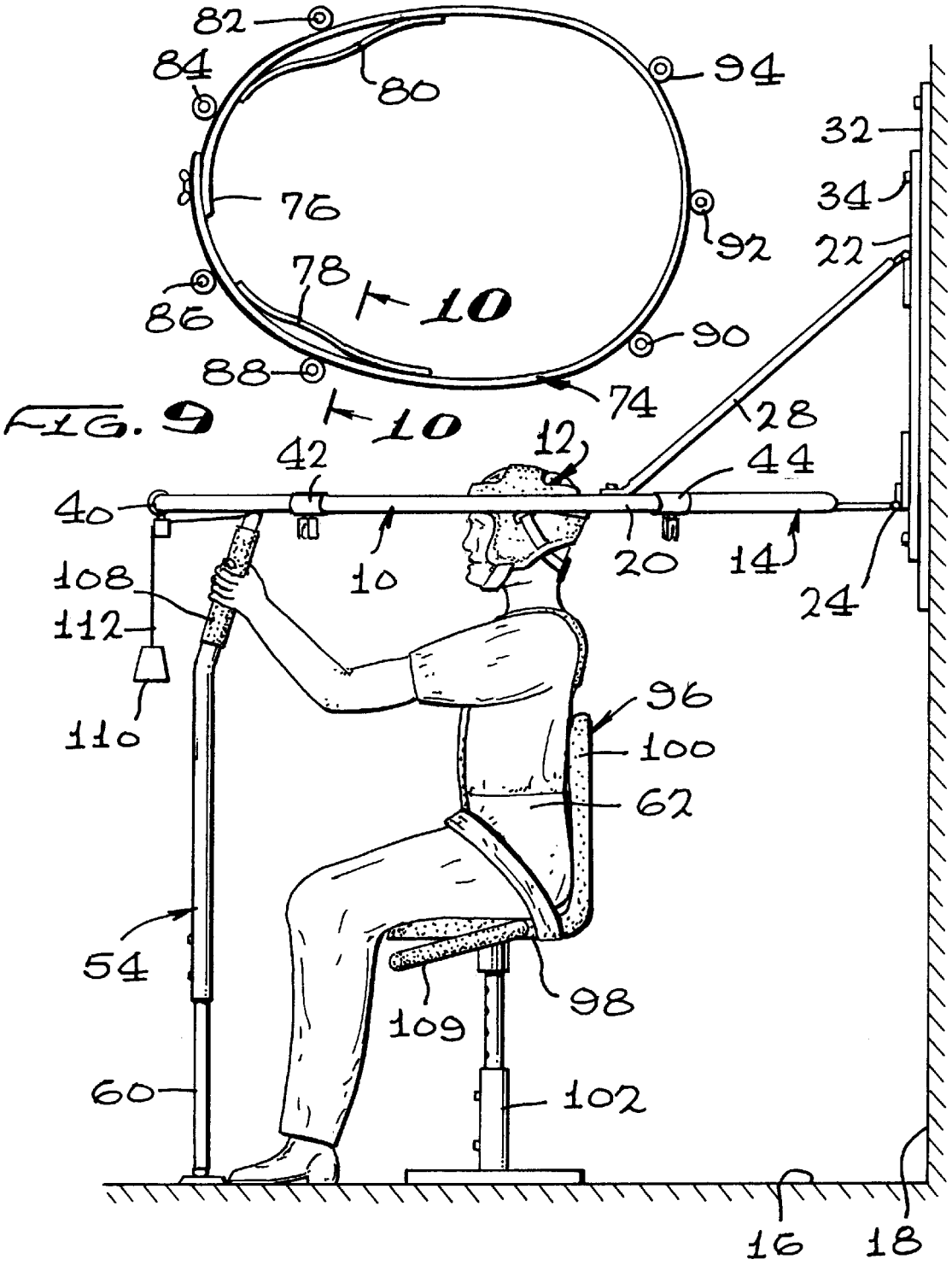
FIG. 3 is a left side elevational view thereof.
FIG. 9 is a plan view of the steel band attached to the helmet.

The neck therapy exercise apparatus of this invention is generally indicated at 10 in FIGS. 1, 2 and 3. The apparatus comprises two principal parts which are the helmet 12 and resistance frame 14. The floor 16 and wall 18 are in a conventional room serve as support and reference for the apparatus. They are at a conventional right angle, see FIG. 3. Resistance ring 20 is a circular ring made of circular section tubing. The diameter of resistance ring 20 is preferably about 3 to 4 feet. The resistance ring is mounted on plate 22 by hinge 24 and braces 26 and 28. The braces may be detachable or hinged at the upper end to permit the resistance ring to swing upwardly or downwardly to lie closely to the wall 18 for storage purposes. That is the non-operative position. The operative position is shown in FIGS. 1, 2 and 3 wherein the plane of the resistance ring is substantially at a right angle to wall 18 and parallel to floor 16.

Plate 22 is mounted on rails 30 and 32. The rails are secured to the wall 18 in an upward direction so that they are positioned substantially at a right angle with respect to the plane of the floor 16. T-bolts have their T heads engaged in T slots in the rails 30 and 32. The T-bolts extend through plate 22 with thumb nuts engaging on the bolts. See thumb nut 34 in FIG. 3. The plate 22 is moved up and down the wall until the plane of the resistance ring lies substantially in line with the plane through the helmet 12, as described below. The entire structure thus described is the resistance frame.

Figure 4:
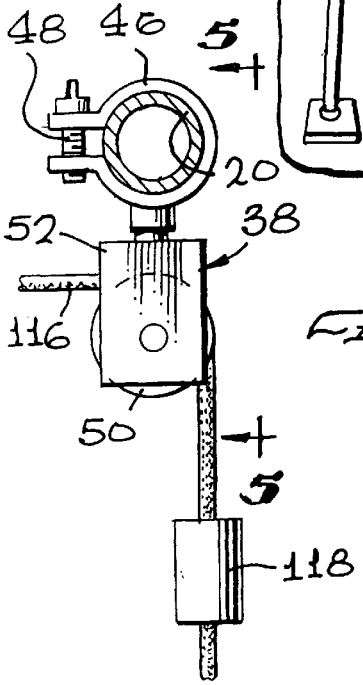
FIG. 4 is an enlarged section taken generally along line 4—4 of FIG. 2, with parts broken away.
Figure 5:
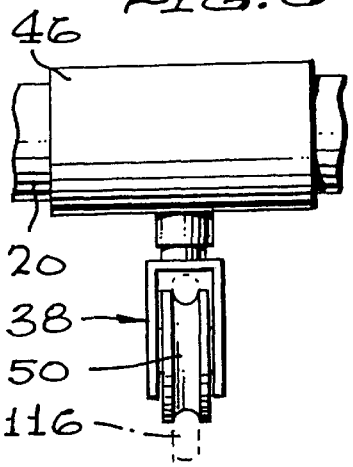
FIG. 5 is an enlarged upright view, with parts broken away, as seen generally along line 5—5 of FIG. 4.

A plurality of pulleys is provided on the resistance frame. Pulleys 36, 38, 40, 42 and 44 are seen in FIG. 2. Pulley 38 is shown in more detail in FIGS. 4 and 5. Strap 46 engages around ring 20 and can be clamped thereto by tightening of clamp screw 48. Pulley wheel 50 is rotatably mounted in pulley housing 52 which in turn is mounted on strap 46. The entire structure is referred to as a pulley. The pulley wheel can be positioned at the desired location around the periphery of the resistance ring 20.

Legs 54 and 56 engage upon the floor and are mounted upon the resistance ring 20. They are positioned sufficiently apart so that they may be readily grasped. The upper portion of the legs are angularly oriented with respect to the vertical so as to be ergonomically positioned for hand grasp. The lower portion of the legs, below the hand grips, may be vertical to maximize support and stability of ring 20. In addition, telescopic leg extensions 58 and 60 form the lowest part of the legs. These telescopic extensions engage the floor and are adjustable with the adjustment of the height of the wall mounting plate 22. Thus, desired height of the ring 20 can be achieved and it can be secured at that height.

Figure 7:
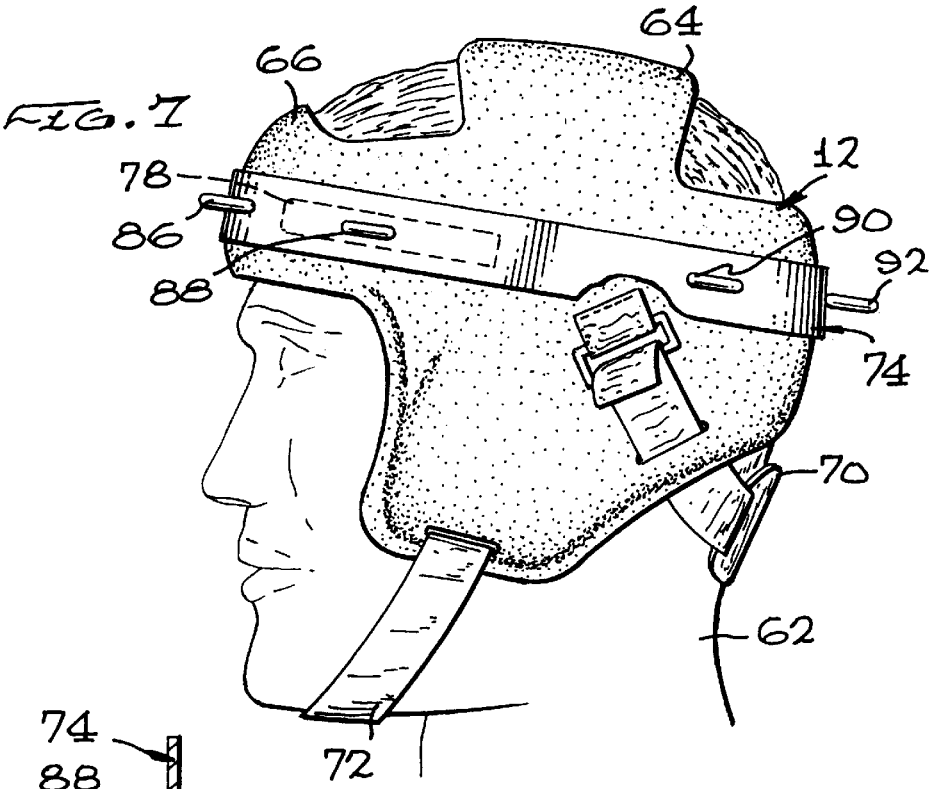
FIG. 7 is a left elevational view of the helmet, as shown being worn by the user of the exercise apparatus.
Figure 10:
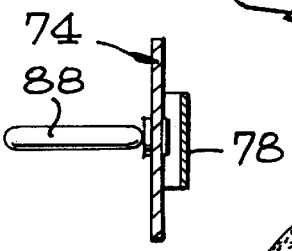
FIG. 10 is an enlarged section through the steel band.
Figure 8:
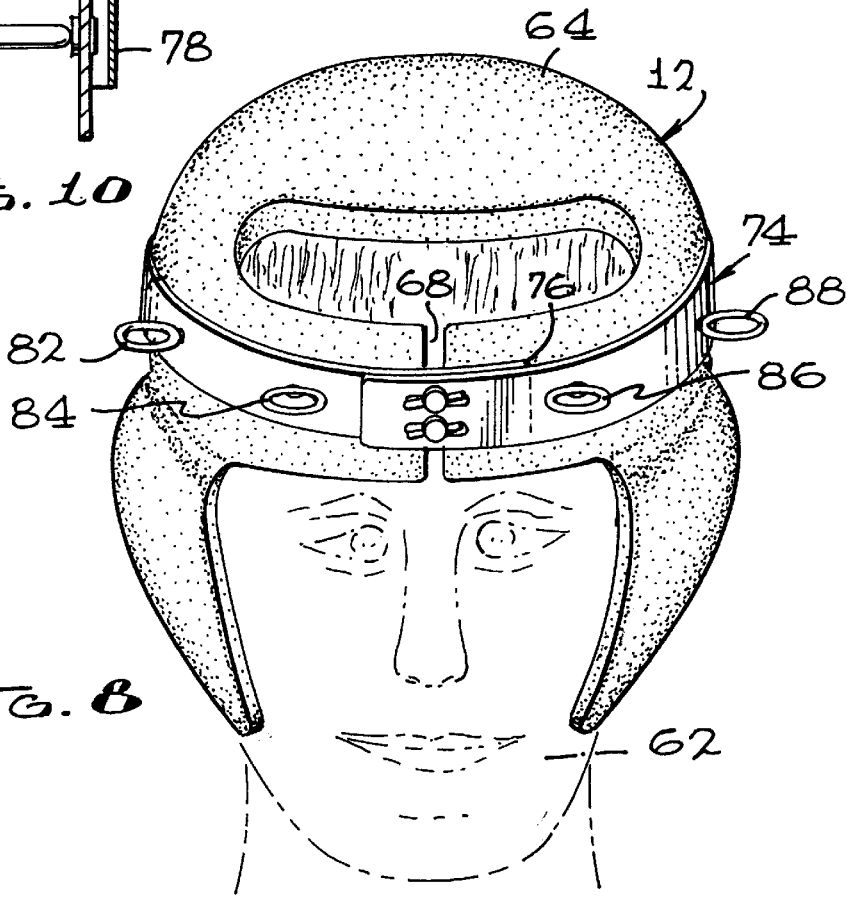
FIG. 8 is a front view thereof.

The user 62 wears the helmet 12 when he is using the neck therapy exercise apparatus of this invention. The helmet 12 is seen in more detail in FIGS. 7 and 8. The helmet 12 may be formed of a molded synthetic polymer shell with a padded foam liner which substantially fits the head. The helmet dome or band 64 extends over the top of the head and the forehead band 66 is slotted at 68 to permit circumferential adjustment of the helmet. At the rear, an occiput band 70 engages under the back of the skull and chin strap 72 engages under the user's chin. Both the occiput band and chin strap are adjustable and detachable by means of a hook and pile fastener so that a proper fit can be achieved on the user's head. Rigid strap 74 is attached to the polymer portion of the helmet. It extends over the forehead, around the temples, above the ears and above the occiput at the back of the helmet. The rigid strap 74 is a band which goes around the head on the outside of the polymer portion of the helmet. Overlapping ends of the band at 76 permit adjustment of circumference, together with opening and closing of slot 68. Screws and slots at the band ends at the overlap permit attachment of the ends to each other at the desired size. FIGS. 9 and 10 are views of the band itself. Interiorly of the band there are attached temple springs 78 and 80. These springs urge the polymer portion of the helmet to bend inwardly over the temples to decrease the circularity of the band to thus more firmly anchor the band upon the user's head. Six to eight eyes are attached to the band 74. Seven eyes 82, 84, 86, 88, 90, 92 and 94 are seen in FIG. 9.

The purpose of the neck therapy exercise apparatus is to provide for well-defined and controlled cervical spine exercise. In order to accomplish this it is also necessary to position and stabilize the trunk of the body. Chair 96 has a conventional seat 98 and back 100. Chair support 102 is mounted on the floor and is telescoping to provide the correct height for the user's comfort. His feet should be solidly on the floor, as shown in FIG. 3. Harness 104 may engage the user's trunk in order to properly stabilize and position his torso by attachment to the chair, thus isolating movement to the musculature of the cervical spine. In this position the band 74 on the helmet lies substantially in the plane of the ring 20 of the resistance frame, although the band normally will lie at a slight angle to the horizontal (see FIG. 7). Of course, head movement by the user during therapeutic exercises often will cause the band 74 to depart from the plane of the ring 20. Hand grips 106 and 108 on the top of legs 54 and 56 are ergonometrically positioned to be comfortably grasped and to maintain the upper extremity in a position compatible with cervical extension movements. Hand grips 107 and 109 on the chair 96 are ergonomically located in a position compatible with cervical flexion movement when appropriately prescribed. In this position the user's helmet is substantially centered within the resistance frame. The same relative positions can be obtained without the chair. In such a case, the user would be standing and the resistance frame would be raised so that its plane would lie substantially within the plane of the helmet ring.

The pulleys 36–44 can be moved around the resistance ring 20 to the selected position for which resistance is required. At least one cord and weight are hooked through one pulley to provide the resistance to the selected exercise. Two or more such weights and pulleys can be connected up to provide torque and linear resistance to neck movements in the manner and direction required. The use of clamp 118 on the several cords limits the exerciser's amount of motion to avoid too great a traverse and to further isolate specific movements.

The user is positioned so that the strap 74 and its eyes on the helmet 12 lie substantially in the plane of the resistance frame. This avoids forces applied to the head by the apparatus which would increase the compressive load on the spine.

The user is thus positioned for exercise. In order to provide resistance to the cervical spine exercise, weights are attached to cords which pass through selected pulleys and attach to selected eyes on the helmet. In FIG. 1 weight 110 is connected to cord 112 which has on its end a hook hooked to eye 86. Similarly, weight 114 is attached to cord 116 which goes through pulley 38. The cord 116 has a hook on its end which is attached into eye 84. In addition, a clamp 118 can be positioned on any one or more of the cords to limit upward motion of the weight thereon, to thus limit the amount of travel of the cord to limit the user's head motion. The clamp thus limits the amount of excursion of the head from the central position.

If the user is instructed to do an exercise by diagonal nodding'to the right or diagonal nodding to the left, he brings his head back from the nod against the resistance offered by the loads of the weights 110 and 114. Furthermore, these weights apply a right or left rotational torque as viewed from the top, so the prescribed nodding exercises are done in the presence of that torque resistance. This application of resistance to nodding and rotating movements most closely simulates normal cervical function. Through these exercises, the torso remains in place as a result of the arm extension and hand grasp as well as the harness and chair positioning.

In order to be helpful, rather than harmful, an expert knowledge of the joints, muscles and synergistic movement patterns is necessary to determine the correct exercises. The unique therapy exercise apparatus provides simultaneous resistance to combined movement such as, for example, left rotation, extension and left side bend, in order to restore normal movement patterns or retrain dysfunctional cervical movements in order to rehabilitate the user from various cervical dysfunctions. The apparatus thus serves as a supplement to manual theraputic techniques used by physical therapists. The apparatus is compatible with the necessary complex movements and provides specific force resistance for each of the movements. The apparatus provides resistance to exercise as needed in various combinations and proportions of the primary movement of rotation, flexion, extension and side bend. These movements will be used against resistance to develop muscular strength. The appropriate strength in the muscles prevents joints from going into dysfunctional position ranges. The apparatus offers resistance to concentric, isometric and eccentric movements. Vertebreal levels can be isolated with proper torso stabilization and cord clamp adjustment.

This invention has been described in its presently contemplated best embodiments and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A neck therapy exercise apparatus comprising:

a substantially circular, substantially planar resistance frame having an open center, at least first and second pulleys mounted on said resistance frame, said pulleys being moveable around said resistance frame to selected positions for desired direction of exercise resistance, first and second cords respectively passing through said first and second pulleys, first and second weights respectively attached to said first and second cords;

a helmet configured to attach to the head of a person to receive neck therapy exercise, said helmet having resilient temple engaging structure to resist rotation of said helmet on the head, said helmet having a plurality of attachment points therearound, said first and second cords being attached to said helmet at selected ones of said plurality of attachment points on said helmet, said apparatus being positioned so that, when the person is wearing said helmet for exercise, said helmet is positioned within the interior opening of said resistance frame and said cords are substantially horizontal so that rotational, flexion, extension and side bend neck exercises can be accomplished against resistance without substantial compressive head and neck forces.

2. The neck therapy exercise apparatus of claim 1 wherein said substantially circular, substantially planar resistance frame carries first and second hand grips thereon, said hand grips being positioned so that, when the user grasps said hand grips, his arms are positioned substantially in a pattern most compatible with specific neck movement being performed and the torso is stabilized by said hand grips.

3. The neck therapy exercise apparatus of claim 1 wherein said substantially circular, substantially planar resistance frame carries first and second hand grips thereon, said hand grips being positioned so that, when the user grasps said hand grips, his torso is positioned substantially centrally of said substantially circular, substantially planar resistance frame and the torso is secured in position by said hand grips.

4. The neck therapy exercise apparatus of claim 1 wherein said pulleys are positionable at selected positions on said substantially circular, substantially planar resistance frame so that direction of resistance to exercise can be defined and adjusted.

5. The neck therapy exercise apparatus of claim 4 wherein at least one of said cords has a stop thereon between said weight and said pulley to limit the distance said helmet can be moved against resistance with respect to said resistance frame.

6. The neck therapy exercise apparatus of claim 5 wherein there are first and second hand grips on said resistance frame, said hand grips being positioned to be grasped by the user to help the user work against resistance as he exercises his neck to maintain proper position with respect to said apparatus.

7. The neck therapy exercise apparatus of claim 4 further including a chair positioned below said substantially circular, substantially planar resistance frame, said chair being for securement of the user's torso, said chair being positioned with respect to said resistance frame so that the user's head lies in a position so that, when he is wearing said helmet, said helmet is substantially centrally located within said resistance frame and said attachment points on said helmet lie substantially in the plane of said substantially circular, substantially planar resistance frame.

8. The neck therapy exercise apparatus of claim 7 wherein said substantially circular, substantially planar resistance frame has mounting means thereon for supporting said resistance frame.

9. The neck therapy exercise apparatus of claim 8 wherein said mounting means for said substantially circular, substantially Planar resistance frame is vertically adjustable mounting means so that said mounting means and said resistance frame can be selectively vertically positioned to position the height of said resistance frame substantially at the height of said helmet when said helmet is being worn by the user.

10. A neck therapy exercise apparatus comprising:

a substantially circular, substantially planar resistance frame having an open interior, a plurality of pulleys mounted on said resistance frame, said pulleys being positionable around the open interior of said resistance frame to selected positions, a cord through each selected ones of said pulleys and a weight of selected weight attached to each of said cords;

mounting means for supporting said resistance frame, first and second handgrips on said resistance frame; and a helmet, said helmet having resilient temple engaging structure to resist rotation of said helmet upon the head, said helmet having a plurality of attachment means thereon for attaching selected ones of said cords to selected ones of said attachment means, said resistance frame and said handgrips being positioned so that, when a user who employs said neck therapy exercise apparatus wears said helmet and grasps said handgrips, said helmet lies substantially in the plane of said resistance frame so that forces are applied by said weights through said cords to said helmet to provide resistance to exercise motion of the user including rotation, flexion, extension and side bend exercise motion.

11. The neck therapy exercise apparatus of claim 10 wherein said helmet has a rigid band around the crown of said helmet and said rigid band carries said attachment means thereon.

12. The neck therapy exercise apparatus of claim 11 wherein said attachment means comprises a plurality of eyes attached to said rigid band.

13. The neck therapy exercise apparatus of claim 12 wherein said band has interior elements therein positioned over the temples of the user so as to aid in preventing rotation of said helmet on the head of the user.

14. The neck therapy exercise apparatus of claim 13 wherein said band is adjustable in circumference.

15. The neck therapy exercise apparatus of claim 10 wherein said apparatus includes a chair for positioning the torso of the user so that said helmet when worn by the user is positioned substantially in the plane of said resistance frame.

16. A neck therapy exercise apparatus, comprising:

a helmet being configured to extend over the head of the user, said helmet having resilient temple engaging structure to resist rotation of said helmet on the head, said helmet having a chin strap and an occiput band for securing said helmet to the head of the user and a rigid band around said helmet, said rigid band having attachment points thereon;

a substantially circular, substantially planar resistance frame, at least first and second pulleys movably mounted on said resistance frame, at least first and second tension cords passing over respective ones of said pulleys, each of said cords being attached at one end to a respective one of said attachment points and having a weight on its other end for exercising the musculature related to the cervical spine of the user by moving said helmet against resistance including rotation, flexion, extension and side bend exercise.

17. The neck therapy exercise apparatus of claim 16 wherein said rigid band is adjustable in circumference.

18. The neck therapy exercise apparatus of claim 16 wherein said helmet has a slot on the interior portion thereof and said rigid band has an overlapping adjustment section adjacent said slot so that helmet size can be adjusted.

* * * * *